US007819577B2

(12) United States Patent
Greco et al.

(10) Patent No.: US 7,819,577 B2
(45) Date of Patent: Oct. 26, 2010

(54) CLAMPING DEVICE AND METHOD TO TEMPORARILY CLAMP, IN A MIXING MACHINE, A CONTAINER CONTAINING A FLUID PRODUCT

(75) Inventors: Guido Greco, San Felice Sul Panaro (IT); Fabrizio Benatti, Cavezzo (IT); Andrea Capucci, Mirandola (IT)

(73) Assignee: CPS Color Equipment Spa Con Unico Socio, San Felice Sul Panaro (IT)

( * ) Notice: Subject to any disclaimer, the term of this patent is extended or adjusted under 35 U.S.C. 154(b) by 977 days.

(21) Appl. No.: 11/630,611

(22) PCT Filed: Jun. 29, 2005

(86) PCT No.: PCT/IB2005/001847

§ 371 (c)(1),
(2), (4) Date: Dec. 22, 2006

(87) PCT Pub. No.: WO2006/006025

PCT Pub. Date: Jan. 19, 2006

(65) Prior Publication Data

US 2009/0190437 A1 Jul. 30, 2009

(30) Foreign Application Priority Data

Jun. 30, 2004 (IT) ..... UD2004A0136

(51) Int. Cl.
*B01F 11/00* (2006.01)

(52) U.S. Cl. ..... 366/209; 366/605

(58) Field of Classification Search ..... 366/605
See application file for complete search history.

(56) References Cited

U.S. PATENT DOCUMENTS

| | | | | |
|---|---|---|---|---|
| 5,268,620 | A | 12/1993 | Hellenberg | |
| 5,662,416 | A | 9/1997 | Dwigans, II | |
| 2004/0008573 | A1 | 1/2004 | MacDonalnd et al. | |
| 2004/0013031 | A1 * | 1/2004 | Salas et al. | 366/605 |

FOREIGN PATENT DOCUMENTS

WO WO 03/028872 4/2003

* cited by examiner

*Primary Examiner*—Walter D Griffin
*Assistant Examiner*—Timothy Cleveland
(74) *Attorney, Agent, or Firm*—Hamre, Schumann, Mueller & Larson, P.C.

(57) ABSTRACT

Clamping device and method to temporarily clamp, in a mixing machine (11), a container (12) containing a fluid product, comprising two clamping elements (20, 21), opposite each other and able to clamp the container (12) in a determinate position. A movement mechanism (22), controlled by a control unit (24), is able to reciprocally move the clamping elements (20, 21) and impart thereto a clamping force (F) or clamping impulse, according to the actual height (L) of the container (12). The control unit (24) is also able to calculate, as a function of the clamping force (F), a relative clamping speed (v3), at which to move reciprocally the two clamping elements (20, 21) so as to clamp the container.

15 Claims, 7 Drawing Sheets

CLAMPING DEVICE AND METHOD TO TEMPORARILY CLAMP, IN A MIXING MACHINE, A CONTAINER CONTAINING A FLUID PRODUCT

FIELD OF THE INVENTION

The present invention concerns a clamping device and method to temporarily clamp, in a mixing machine, a container containing a fluid product to be mixed, for example a painting substance. The device comprises two clamping plates, respectively a supporting plate on which the container is rested, and a pressure plate, which cooperates with the supporting plate so as to temporarily clamp the container in a determinate position, and a movement mechanism which moves at least one of said plates towards the other. A command and control unit controls the above movement mechanism and, consequently, the movement of the clamping plates so as to guarantee that the container is clamped before the cycle to mix the fluid product is started and, at the end of the cycle, to allow the container to be removed from the mixing machine.

BACKGROUND OF THE INVENTION

A clamping device is known, applied to mixing machines, which allows to clamp a container containing a fluid product, for example paint, in a determinate position before the start of a cycle to mix the paint.

During this cycle, the mixing machine imposes a series of movements on the container, for example simultaneous rotations around one or more axes, oscillations along the longitudinal and transverse axes, or a combination of the movements, so as to mix the paint contained in the container.

The clamping device comprises a supporting plate, on which the container is rested, and a pressure plate, located at a determinate distance from the supporting plate and coaxial therewith. Both the plates are connected to a worm screw, or a rack device, made to rotate by an electric motor.

The direction of rotation of the screw, or the main gear of the rack, determines the reciprocal approach or distancing of the two plates and, consequently, the clamping or release of the container.

A command and control unit controls the electric motor and detects the quantity of current absorbed. This current is constant during the reciprocal approach and distancing of the plates, while it grows when the upper plate contacts the container, since the latter impedes the reciprocal approach of the plates.

A determinate increase in the quantity of current absorbed by the electric motor represents a corresponding increase in the pressure applied by the plates on the container, hence a relative clamping force applied to the container.

This device has a disadvantage, however, in that the current absorbed by the electric motor can have an irregular, unpredictable development, for example due to incrustations present on the thread of the worm screw and/or irregularities in the assembly or in the construction of the screws. Similar anomalies occur if a device with gears is used.

The above incrustations and/or frictions of other type are an obstacle to the movement of the clamping plates and can slow down their speed in the step of reciprocal approach. This prevents the correct determination of the clamping force which the said plates have to apply to the container.

Moreover, the above incrustations and/or frictions of other type can slow down and even block the reciprocal approach of the plates before the pressure plate actually contacts the surface of the container, with a consequent blockage of the electric motor, without the container being effectively clamped.

Starting the mixing cycle without the container being clamped with the correct and pre-set level of clamping force, or even without the container being clamped at all, can lead to very serious problems in the mixing cycle.

Another disadvantage is that, in known devices, the clamping force is pre-established at a given value, irrespective of the size, particularly the height, of the containers. This means that, for example, the pre-set value of the clamping force can be too low if the container is large, and can entail an ineffective clamping in the subsequent mixing cycle, or too high if the container is small, or made of plastic material, and possibly leading to the deformation of the container itself.

Clamping devices are also known which determine and memorize the height of the container, by means of a first approach of the pressure plate until it contacts the container. Subsequently, the pressure plate is distanced from the container by some millimeters, irrespective of the height of the container, and is subsequently returned in proximity with the latter until it contacts it again with a pre-determined force.

However, even in these conventional devices the clamping force is not determined automatically according to the actual detected height of the container, but is determined in advance, or set by the user.

One purpose of the present invention is to construct a clamping device, applied on a mixing machine, which automatically guarantees an effective and precise clamping of the container, at least according to the height of the latter and before the mixing cycle is started.

Another purpose is to be able to use the device with containers substantially of any size and/or material whatsoever, determining, at the start of the cycle and according to said size and material, the most suitable clamping force to ensure a correct clamping and prevent damage to the container.

The Applicant has devised, tested and embodied this invention to overcome the shortcomings of the state of the art and to obtain these and other purposes and advantages.

SUMMARY OF THE INVENTION

The present invention is set forth and characterized essentially in the main claims, while the dependent claims describe other innovative characteristics of the invention.

In accordance with these purposes, a clamping device according to the present invention is applied to a mixing machine in order to temporarily clamp a container containing a fluid product to be mixed.

The clamping device comprises a first clamping element, on which the container is able to be disposed, a second clamping element, opposite the first clamping element and able to cooperate with the latter in order to clamp the container in a determinate position, and at least a movement mechanism, able to move at least one of the clamping elements towards the other.

The mixing machine can be of the gyroscopic type, or rotational, in which case both the clamping elements can be reciprocally mobile, or of the vibratory type, in which case a first clamping element, the lower one, is fixed and functions as supporting elements for the container, while the other clamping element, disposed above the first, is mobile with respect thereto.

The device also comprises command and control means, associated with the movement mechanism to cause a first reciprocal approach of the clamping elements, until they contact the ends of the container, so as to detect the position and calculate and memorize the height L thereof.

Moreover, after the first contact with the container, the command and control means cause a first temporary separation and then a second reciprocal approach of the clamping elements.

In accordance with a characteristic of the present invention, the command and control means comprise first means able to calculate, at least according to the height L of the container, a clamping force F, or a clamping impulse, to be applied to the container, and second means able to calculate, according to said clamping force F, a relative clamping speed v3, at which to reciprocally move the two clamping elements, so as to clamp the container between the two clamping elements with the correct clamping force F as thus determined.

In this way, the command and control means are able to determine both the clamping force F and also the relative clamping speed v3 of the clamping elements according to the actual height L of the container, as detected at the end of said first approach.

The clamping force F of the clamping elements is determined by means of an algorithm which implements an equation, or by means of a table, or a force-height curve found experimentally and memorized in electronic memory means.

The relative clamping speed v3 is also obtained by means of an algorithm which implements an equation, or by means of a table, or a speed-force interpolation curve found theoretically, verified experimentally, and memorized in electronic memory means.

According to an advantageous solution of the present invention, the first distancing is performed in a constant time T2, irrespective of the height L of the container.

In this way, in time T2 the clamping elements are reciprocally distanced at a speed v2 which is a function, for example inversely proportionate, to the actual height L detected at the end of the first approach.

According to a preferential embodiment the movement mechanism comprises at least a screw element, which is connected to the clamping elements and is driven by at least an electric motor, controlled by the command and control means.

According to another preferential embodiment, sensor means are associated both with the electric motor and also with the command and control means, so as to detect the height L of the container during said first reciprocal approach of the clamping elements.

The sensor means are able to periodically effect a detection of the distance traveled by the clamping elements and to send a corresponding signal to the command and control means. The latter are able to memorize the signals generated by the sensor means, so as to determine the overall distance traveled by the clamping elements with respect to an initial position thereof.

The command and control means are also able to intervene, in timed manner, that is to say, moment by moment, in order to ensure that the aforesaid value of speed relating to said clamping elements is achieved and maintained, through said detections performed by the sensor means and consequently by varying the feed tension of said electric motor.

The clamping method according to the present invention comprises the following steps, in sequence:

a step of first approach, wherein the clamping elements are brought close to each other at a relative first approach speed v1;

a step to recognize that contact has occurred between the second clamping element and the container, at the end of said first approach step, and that the value of the height L of the container has been acquired;

a first distancing step, wherein the clamping elements are distanced from each other at a relative first distancing speed v2.

In accordance with a characteristic of the present invention, the method provides, during the recognition step, to calculate the value of the clamping force F, or clamping impulse, to be applied to the two clamping elements in order to clamp the container as a function of the height L of the container; it also provides to calculate, as a function of the clamping force F, the value of the relative clamping speed v3, at which the two clamping elements are reciprocally moved, so as to clamp the container between the two clamping elements with the clamping force F.

The method according to the present invention also comprises the following steps:

a second approach step, wherein the clamping elements are brought close together at the relative clamping speed v3, until they return to the position of contact against the container;

a clamping step, wherein the container is clamped in the contact position with the clamping force F before the mixing cycle of said fluid product is started;

a step of second distancing, wherein, at the end of the mixing cycle, the two clamping elements are reciprocally distanced at a second distancing speed v4 and v5 in order to allow the container to be removed from the mixing machine.

In the first approach step, the reciprocal displacement of the clamping elements occurs according to a pre-set speed profile, for example with a speed that decreases over time, so that the two clamping elements contact containers having a great height L at a high relative speed, and contact containers having a low height L at a low relative speed.

Said speed profile is controlled by the command and control means, and can be modified according to the requirements of the application so as to reduce the times needed to move the clamping elements.

In the recognition step, the height L of the container is determined, based on the initial distance between the clamping elements and the overall distance traveled by them, during the first approach step.

In this way it is possible to effectively clamp containers of different sizes and materials with corresponding clamping forces, with no risk of deforming or breaking the containers.

In the first and second distancing steps, the clamping elements are moved at speeds v2, v4, v5, defined by the command and control means according to the height L of the container, in order to reduce the times needed to move the clamping elements and make them independent of the height L of the container. Therefore, we have a higher speed when there are small containers, that is, when the clamping elements have a longer distance to travel, and a lower speed when there are large containers, that is, when the clamping elements have a shorter distance to travel.

In order to allow, at the end of the mixing cycle, a reduced time to re-open the clamping elements and a more precise re-positioning of the clamping elements independently with respect to the weight of the container, the second distancing step comprises:

an initial step wherein the clamping elements move at a relative first distancing speed v4, defined by the command and control means according to the height L of the container, in order to travel over a first section of the distancing travel, and a final step wherein the clamping elements are moved at a relative second distancing speed v5, less than the first, in order to travel over a second section of the distancing travel and reach the initial position: when this is reached the container can be removed from the machine.

By means of the clamping device according to the present invention, it is possible to have the certainty that the container is clamped with the desired clamping force F, before the start of the mixing cycle for the product contained therein, whatever the size of the container, and without the size of the container having to be known in advance and hence inserted as a process parameter.

BRIEF DESCRIPTION OF THE DRAWINGS

These and other characteristics of the present invention will become apparent from the following description of a preferential form of embodiment, given as a non-restrictive example with reference to the attached drawings wherein.

DETAILED DESCRIPTION OF A PREFERENTIAL FORM OF EMBODIMENT OF THE INVENTION

Figure 1:
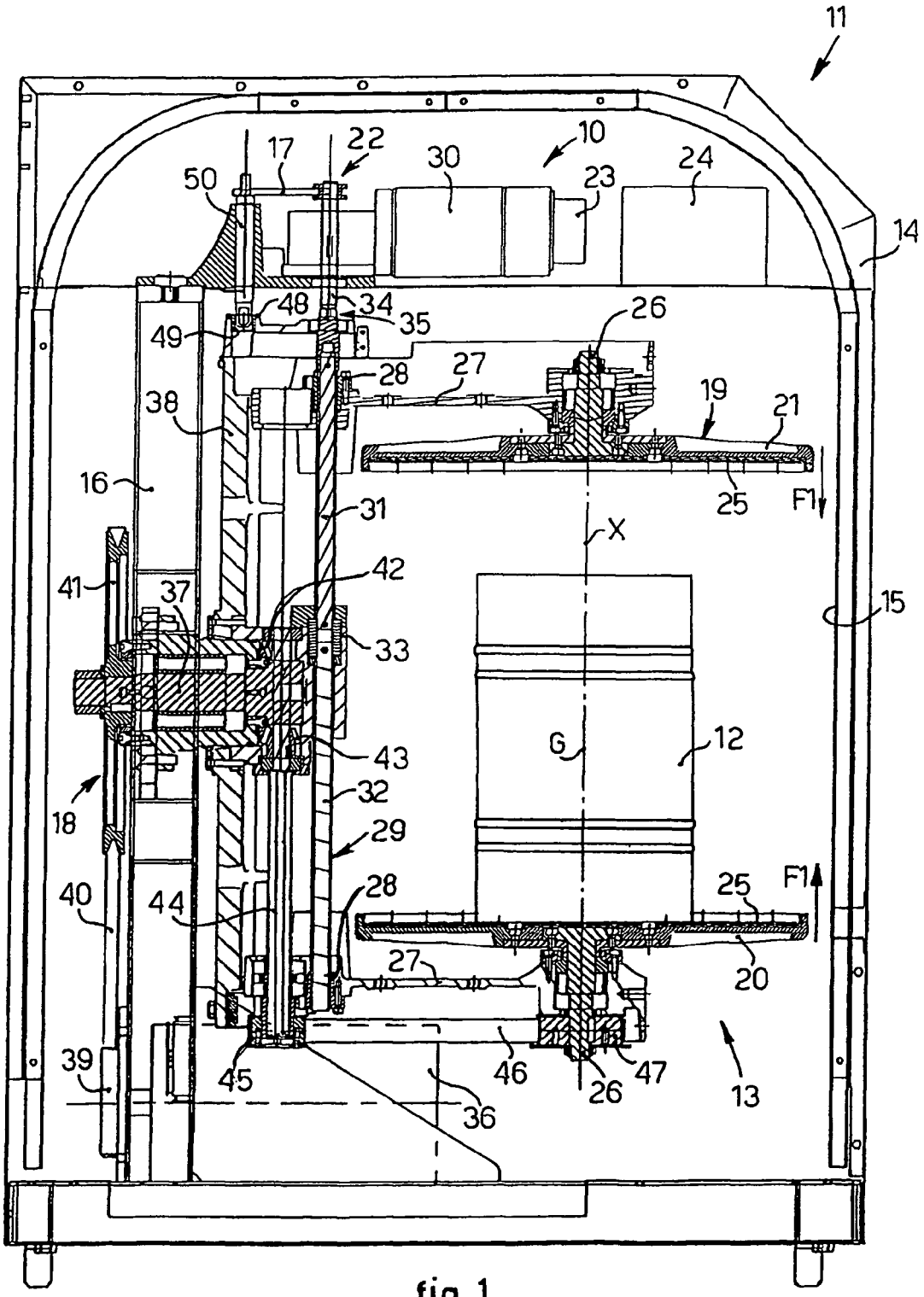
FIG. 1 is a lateral view of a mixing machine on which a clamping device according to the present invention is mounted, shown in a first operating or inactive condition.

With reference to FIG. 1, a clamping device 10 according to the present invention is applied to a mixing machine 11 and allows to temporarily clamp a container 12, for example made of metal, containing a fluid product, for example paint, before the mixing cycle of the fluid product contained in the container 12 is started.

Figure 2:
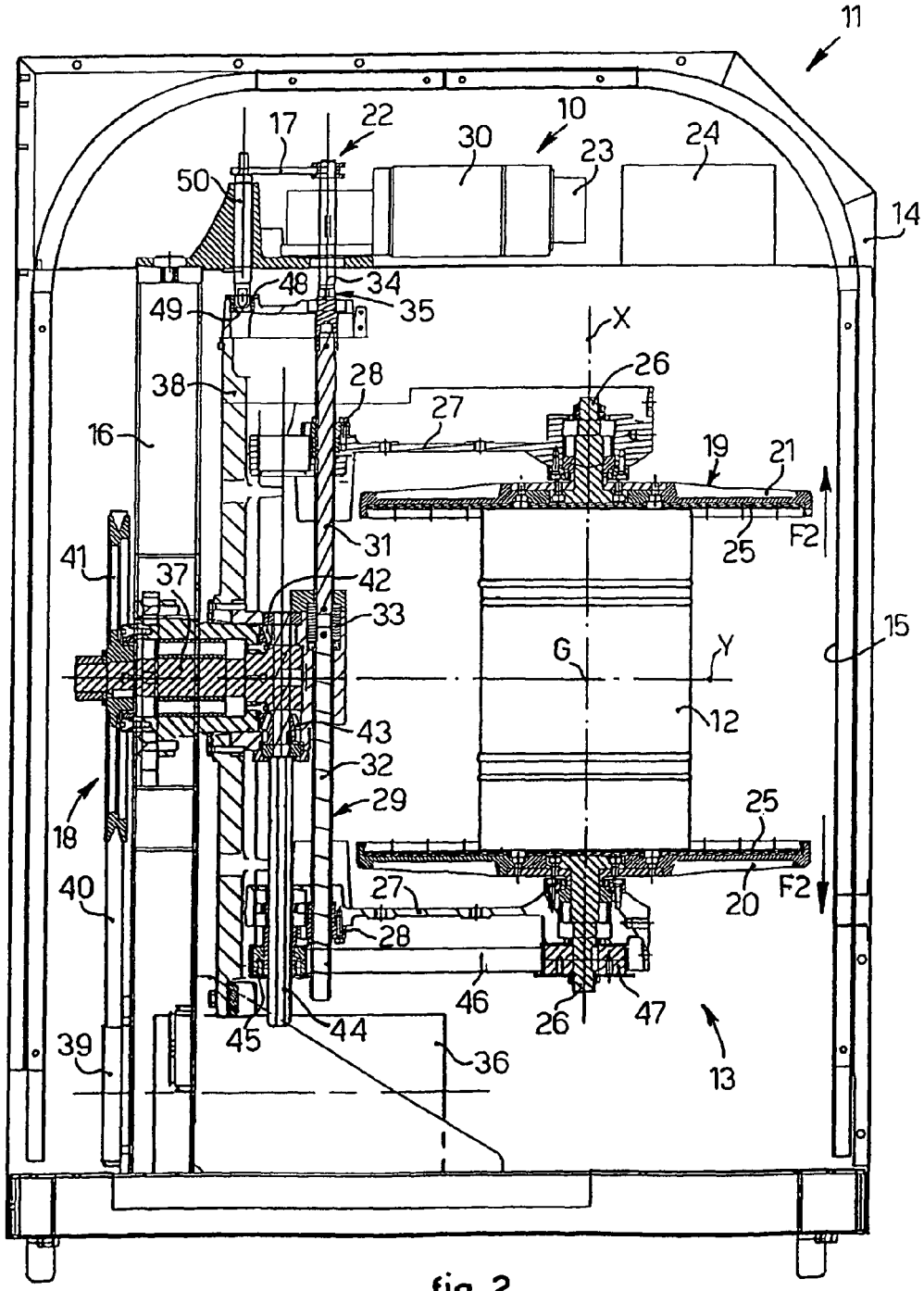
FIG. 2 is another lateral view of the mixing machine in FIG. 1, in a second operating condition.

The mixing machine 11 is for example of the gyroscopic type and comprises a rotary unit 13 by means of which, during the mixing cycle, it is able to make the container 12 rotate both around its longitudinal axis X and also around an axis Y (FIG. 2) perpendicular to the latter and passing through the baricenter G of the container 12.

The mixing machine 11 (FIGS. 1 and 2) also comprises a metal frame 14, defining a mixing chamber 15 and provided with a support 16, on which the rotary unit 13 is mounted. The latter comprises a rotation mechanism 18 and part of the clamping device 10.

The clamping device 10 consists of a gripper mechanism 19 comprising two clamping plates, respectively a supporting plate 20 and a pressure plate 21, a movement mechanism 22 to move the plates 20 and 21, an angular transducer or encoder 23 and a command and control unit 24.

The supporting plate 20 is disposed, when inactive, on the lower part of the mixing chamber 15 (FIG. 1) and the container 12 containing the fluid product to be mixed is rested thereon.

The pressure plate 21 is disposed coaxial with the supporting plate 20, but in the opposite position with respect to the latter and allows, during use (FIG. 2), to clamp the container 12 before the cycle to mix the product contained therein is started.

Both the clamping plates 20 and 21 normally comprise a layer of rubber 25, disposed towards the container 12, which allows them to make an effective clamping of the container 12 and to deaden the impact of the pressure plate 21 against the latter.

Each of the plates 20 and 21 is keyed onto a shaft 26, mounted rotatable at one end of a movable support 27, which comprises a threaded nut 28 at the opposite end.

The movement mechanism 22 comprises a screw element 29, to which the nuts 28 are connected, and an electric motor 30 having a shaft 34 selectively coupled with the screw element 29, as will be described in more detail later.

The screw element 29 comprises two threaded worm zones 31 and 32, one right-hand and one left-hand, joined together by a flange 33.

The electric motor 30 is mounted fixed on the frame 14 and is able to make the shaft 34 selectively rotate. The shaft 34 is connected to one end 35 of the screw element 29.

Figure 3:
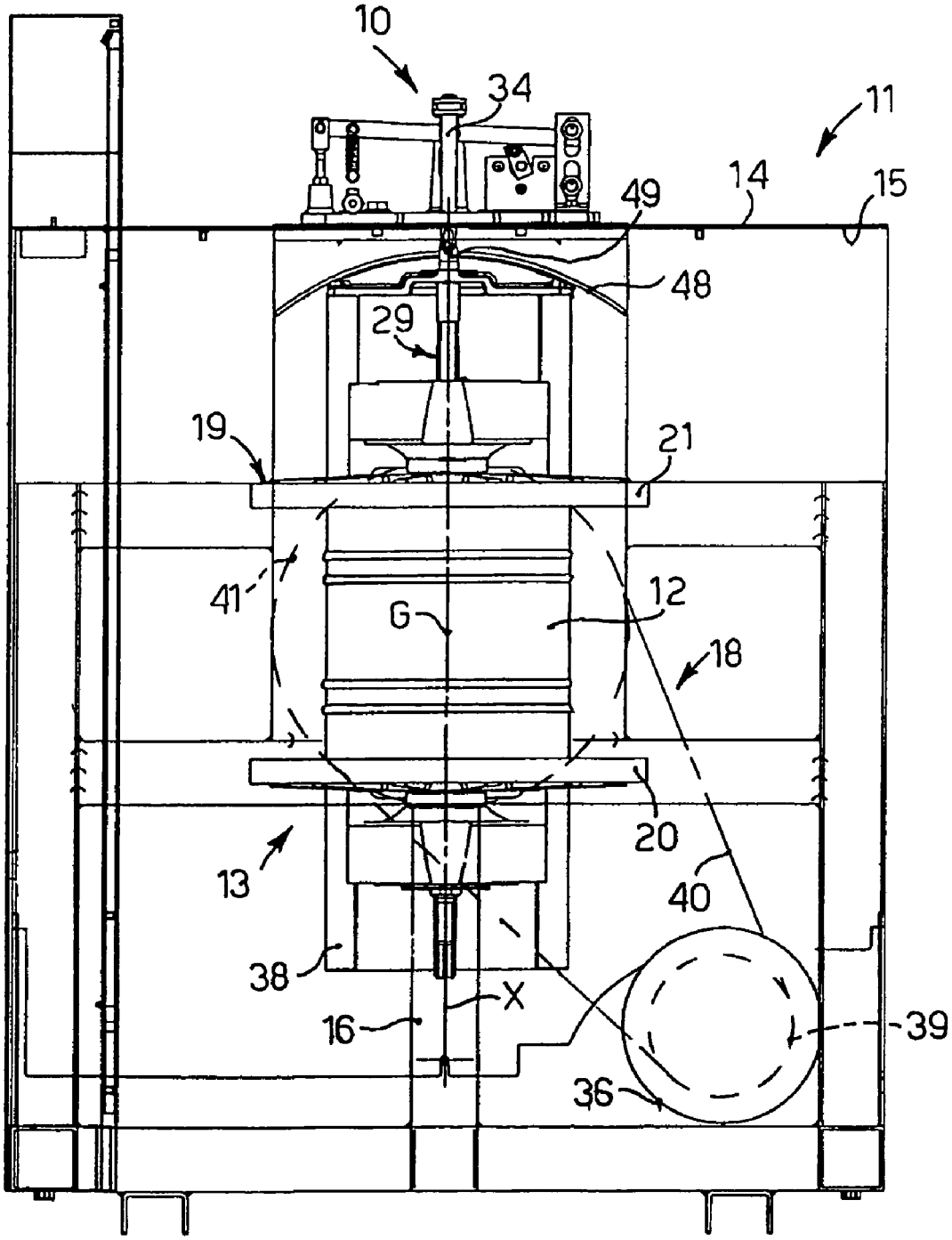
FIG. 3 is a front view of the mixing machine in FIG. 1, in a third operating condition.

The direction of rotation of the electric motor 30 thus determines the reciprocal distancing or approach (FIGS. 1, 2 and 3) of the clamping plates 20 and 21.

The encoder 23 is connected mechanically to the electric motor 30 and electrically to the command and control unit 24 and periodically detects the angular displacement of the shaft of the electric motor 30 with respect to a reference position and, consequently, the distance traveled by the clamping plates 20 and 21 with respect to an initial position thereof.

Figure 5:
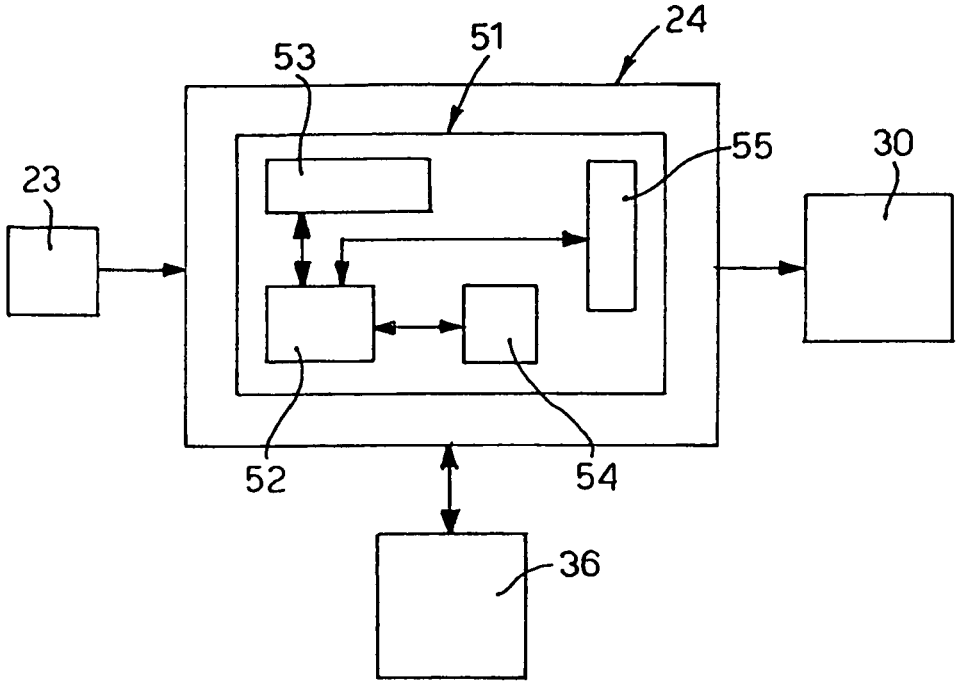
FIG. 5 is a block diagram of the command and control unit of the device in FIG. 1.

The command and control unit 24 (FIGS. 1 and 2) is mounted fixed on the frame 14 and substantially comprises a processor 51 (FIG. 5), having a microprocessor or CPU 53, a random access memory (RAM) 53, an erasable programmable read only memory (EPROM) 54 and an electrically erasable programmable read only memory (EEPROM) 55, connected to the CPU 52.

The operative sequences to achieve the whole clamping method of the clamping device 10 and the mixing cycle of the product contained in the container 12 are memorized in the EEPROM 55; both the signals sent by the encoder 23, and the signals relating to the speed of rotation of an electric motor 36 (FIGS. 1, 2 and 3) of the rotation mechanism 18, are selectively memorized in the RAM 53; the functioning and management program (firmware) of the processor 51 is memorized in the EPROM 54.

The command and control unit 24 is able to command the electric motor 30 according to the detections performed periodically by the encoder 23 and, consequently, it controls the movement mechanism 22, hence controlling the movement of the clamping plates 20 and 21.

The command and control unit 24 is able to detect and memorize the height L of the container 12 when the latter is contacted by both the clamping plates 20 and 21.

Figure 6:
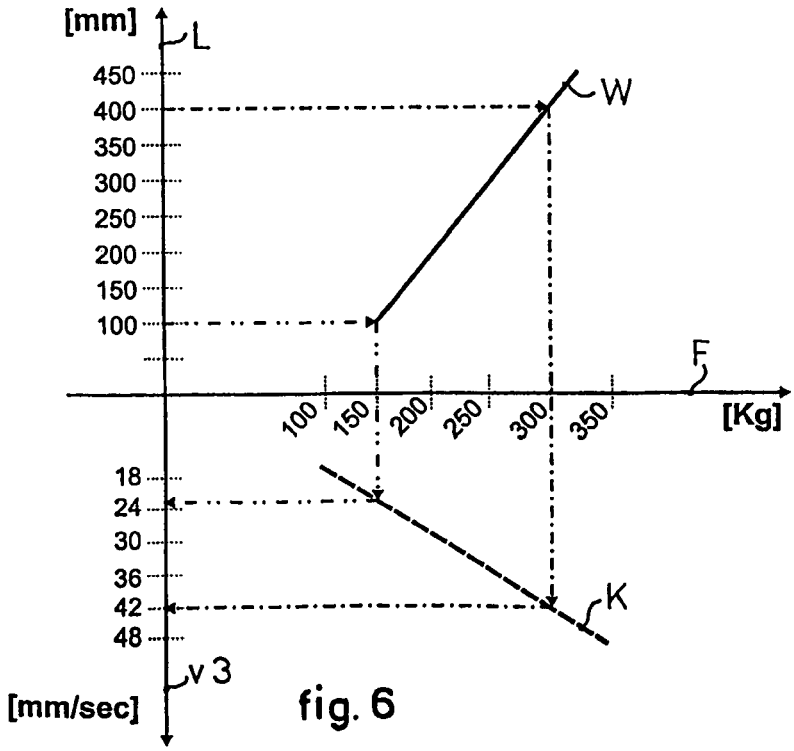
FIG. 6 is a diagram showing the determination of the clamping force and the relative speed of the clamping plates according to the height of the container.

The command and control unit 24 is able to determine the clamping force F which the clamping plates 20 and 21 have to apply to the container 12, as a function of said height L according to a linear relation shown in FIG. 6 and expressed by a curve W.

The command and control unit 24 is also able to determine a relative clamping speed v3 that the clamping plates 20 and 21 have to maintain in order to apply the desired clamping force F on the container 12, using a curve K shown in FIG. 6, found experimentally, which relates, according to a linear link, the clamping force F with the relative clamping speed v3 of the clamping plates 20 and 21.

In order to command the electric motor 30, the command and control unit 24 is able to vary the tension to the heads of the motor 30, so as to make it thus rotate with different speeds and directions of rotation and to cause, as a consequence, a variation in the speed and direction of rotation of the screw element 29 and hence also of the speed of reciprocal distancing, or approach, of the clamping plates 20 and 21.

The rotation mechanism 18 (FIGS. 1, 2 and 3) comprises the electric motor 36 mounted fixed on the frame 14, a shaft 37 mounted rotatable on the support 16 and a rotatable support 38 keyed onto the latter and containing the screw element 29.

The electric motor 36, during the mixing cycle, is commanded by the command and control unit 24 and drives a drive pulley 39, which is connected by means of a belt 40 to a driven pulley 41 keyed onto the shaft 37. A first toothed conical wheel 43 is also keyed onto the shaft 37, and is engaged by a second conical toothed wheel 43. The latter is keyed onto the end of a grooved rod 44, which is mounted rotatable on the rotatable support 38.

A first pulley 45 is mounted on the grooved rod 44 and is connected by means of a belt 46 to a second pulley 47. The latter is in turn keyed onto the shaft 26 on which the supporting plate 20 is keyed.

The rotation of the grooved rod 44 allows the mixing machine 11, during the mixing cycle, to make the container 12 rotate around its longitudinal axis X.

A circular sector 48 is mounted on the rotatable support 38 (FIGS. 1, 2 and 3), from which the end 35 of the screw element 29 protrudes and which comprises a seating 49 into which a vertical pin 50 is able to be inserted. The latter is connected to the shaft 34 of the electric motor 30 by means of a rod 17 and allows to clamp the rotatable support 38 in a determinate fixed position, and to keep it clamped for the entire duration of the operation to clamp the container 12, during which the shaft 34 is also coupled with the screw element 29.

The method according to the present invention comprises, in sequence, the following steps:

- a step A of first reciprocal approach of the clamping plates 20 and 21, at a relative first approach speed v1 (FIGS. 7 and 8);
- a step B to recognize that contact has occurred between the pressure plate 21 and the container 12;
- a step C of first reciprocal and temporary distancing of the clamping plates 20 and 21, at a relative first distancing speed v2;
- a step D of second reciprocal approach of the clamping plates 20 and 21, at a relative second approach or clamping speed v3;
- a step E to clamp the container 12 in the position of contact, before the cycle of mixing the fluid product contained therein, and
- a step F of second reciprocal distancing of the clamping plates 20 and 21, at a relative second distancing speed v4, v5, so as to allow the container 12 to be removed from the mixing machine 11.

Figure 4:
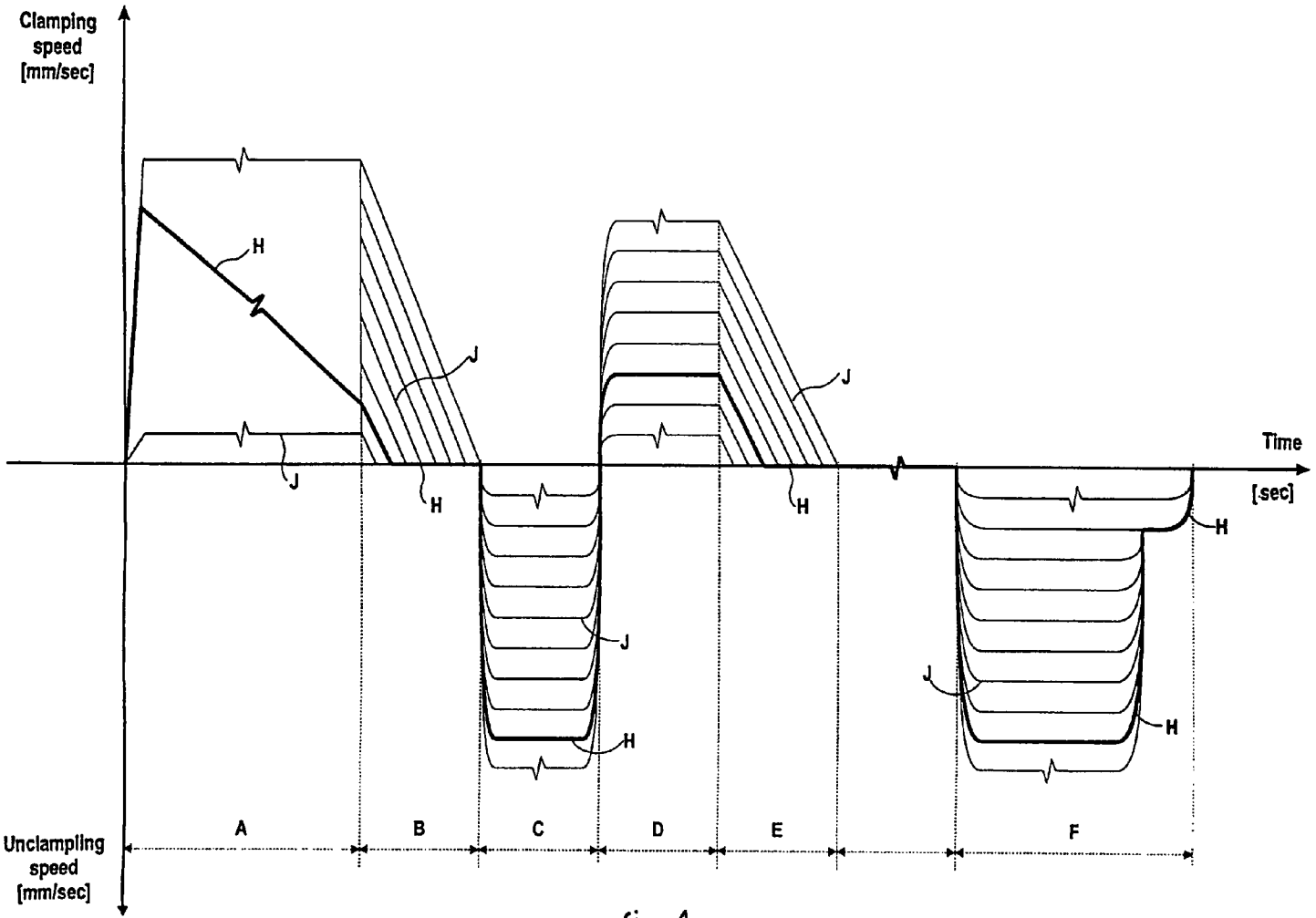
FIG. 4 is a diagram showing the development of the closing speed of the clamping plates of the device in FIG. 1 in the various operating steps wherein the whole mixing cycle is schematized.

The various steps that make up the clamping method are shown in FIG. 4 where H shows, as a function of time, the development of the speed of the clamping plates 20 and 21 for a container 12 of little height. This drawing also shows a plurality of developments of the speeds of the plates 20 and 21 as a function of time, determined by the command and control unit 24 according to the height. L and/or material of the container 12 (curve J).

In the step of first approach A, the electric motor 30 imparts to the screw element 29 a direction of rotation such as to reciprocally bring together (direction F1 in FIG. 1) the clamping plates 20 and 21 according to a pre-set speed profile (curve H in FIG. 4) until the pressure plate 21 contacts the container 12.

This profile provides a decreasing development over time of the first approach speed v1, so that the two clamping plates 20, 21 contact containers 12 having a great height L at a high relative speed, and contact containers 12 having a low speed L at a low relative speed.

The encoder 23, detecting the angular displacement of the shaft of the electric motor 30 with respect to a reference position, periodically detects the distance traveled by the clamping plates 20 and 21 and, with every detection, sends to the command and control unit 24 an electric signal corresponding to the above angular displacement and, as a consequence, the above distance traveled.

The command and control unit 24 memorizes the electric signals sent by the encoder 23 and, consequently, also the distance traveled by the clamping plates 20 and 21 at every detection, thus determining the overall distance traveled by the plates 20 and 21 with respect to their initial position.

Should the value of speed detected by the encoder 23 differ from that pre-defined by the chosen speed profile (curve H), the command- and control unit 24 varies the tension to the heads of the electric motor 30 so as to re-establish the relative pre-defined speed of movement of the clamping plates 20 and 21 and keep it constant, so as to ensure that the chosen speed profile is achieved.

In the recognition step B (FIG. 4), the command and control unit 24 recognizes that contact has been made between the pressure plate 21 and the container 12 (FIGS. 2 and 3), at the end of the first approach step. Due to the rubber layer 25 mounted on both the clamping plates 20 and 21, the encoder 23 detects smaller and smaller distances traveled by the plates 20 and 21 and the command and control unit 24 supplies higher and higher tensions to the heads of the electric motor 30, so as to restore the pre-set profile of the speed of approach of the plates 20 and 21.

When the encoder 23 detects that the distance traveled by the clamping plates 20 and 21 in a determinate period of time is equal to zero, the command and control unit 24 temporarily interrupts the supply of tension to the heads of the electric motor 30, which consequently stops.

The command and control unit 24, according to the initial distance between the clamping plates 20 and 21 and the overall distance traveled by them, determines, by means of the graph shown in FIG. 6, the real height L of the container 12 and, as a function of this, the clamping force F to be applied to said container 12, and hence the correct relative clamping speed v3 for the container 12.

In this step too, should the value of speed detected by the encoder 23 differ from the one pre-defined by the chosen speed profile (curve H), the command and control unit 24 varies the tension to the heads of the electric motor 30 so as to re-establish the relative pre-defined speed of movement of the clamping plates 20 and 21 and keep it constant, so as to ensure that the chosen speed profile is achieved.

Afterwards, the step of first distancing C is performed (direction F2 in FIG. 2), wherein the clamping plates 20 and 21 are reciprocally distanced from each other at the relative first distancing speed v2 defined by the command and control unit 24 according to the calculated height L of the container 12.

To be more exact, if the container 12 is large, then the relative first distancing speed v2 will be low, since the space traveled is limited.

Vice versa, if the container 12 is small, then the relative first distancing speed v2 will be high and the space traveled greater.

This first distancing speed v2 imposed on the plates 20 and 21 is such that the time T2 needed to perform step C is practically constant, whatever the height L detected of the container 12.

Therefore, the greater the relative first distancing speed v2 defined by the command and control unit 24 and imparted to the clamping plates 20 and 21, the greater will be, in the unit of time, both the distance traveled by said plates and also the number of detections performed by the encoder 23 and memorized by the command and control unit 24.

In this step too, should the value of speed detected by the encoder 23 differ from that pre-defined by the chosen speed profile (curve H in FIG. 4), the command and control unit 24 varies the tension to the heads of the electric motor 30 so as to re-establish the relative pre-defined speed of movement of the clamping plates 20 and 21 and keep it constant, so as to ensure that the chosen speed profile is achieved.

When the first distancing step C is finished, the second approach step D is performed, wherein the clamping plates 20 and 21 are reciprocally brought close to the container 12 at the relative second approach or clamping speed v3, substantially constant and equal to the value necessary to obtain the desired clamping force F, in relation to the height L of the container 12 as previously determined.

The encoder 23 continues to periodically measure the distance traveled by the clamping plates 20 and 21, while the command and control unit 24 memorizes the detections made.

Should the value of speed detected by the encoder 23, during step D, differ from that pre-defined, the command and control unit 24 varies the tension to the heads of the electric motor 30 so as to re-establish the relative pre-defined speed of movement of the clamping plates 20 and 21 and keep it constant, so as to ensure that the value of speed (and hence of the clamping force F) pre-defined at the moment of the second contact is achieved.

The clamping step E (FIG. 4) starts when the clamping plate 21 has again contacted the container 12. In this step, the command and control unit 24 verifies if there is congruency between the detections made by the encoder 23 in the steps of first distancing C and second approach D.

At this point, the command and control unit 24, by means of the electric motor 30, imparts the desired clamping force F to the clamping plates 20 and 21.

It may happen that during the first approach step A, one or more incrustations of the fluid product, present on the screw element 29, or other sources of friction, impede the reciprocal approach of the clamping plates 20 and 21 and stop them before the pressure plate 21 actually contacts the container 12. At this point, the command and control unit 24 has memorized a determinate number of signals, generated by the encoder 23, such as to make it determine a height L of the container 12 greater than the real height. Consequently, during the second approach step D, the clamping plates 20 and 21 move towards each other with a greater speed than that relating to the actual height L of the container 12.

During the second approach step D, the incrustation is usually removed from the screw element 29 due to the effect of the movement of the threaded nut 28 on the element 29 itself, so that, during the second approach step D, the clamping plates 20 and 21 travel a greater distance than that traveled in the first distancing step C. Consequently, the command and control unit 24 detects that the number of signals memorized in the second approach step D does not correspond to that of the first approach step C, and inhibits the subsequent clamping step E, and thus, in fact, prevents the mixing cycle being carried out. The mixing machine 11 will thus have to be re-started.

If the clamping step E has occurred regularly, the mixing cycle starts, during which the mixing machine 11, by means of the rotary unit 13, imparts to the container 12 a gyroscopic movement for a determinate period of time, so as to mix the product contained therein.

Before the start of the mixing cycle, the command and control unit 24 commands the shaft 34 and the pin 50 to move away from the end 35 of the screw element 29 and, respectively, from the seating 49, so as to allow the rotation mechanism 18 to make the rotary unit 13 rotate and hence to impose on the container 12 the above gyroscopic movement.

When the mixing step is finished, and the container 12 has been disposed in the vertical position, the pin 50 and the shaft 34 are repositioned respectively in the end 35 and in the seating 49. Subsequently the second distancing step F is started (FIG. 4). This comprises:

an initial step, wherein the command and control unit 24, by means of the electric motor 30, imparts to the clamping plates 20 and 21 a reciprocal distancing with a first relative speed of second distancing v4 (FIGS. 7 and 8), defined by the command and control unit 24 according to the height L of the container 12. The plates 20 and 21 travel at said first speed v4 over a first section of distancing travel, congruent with the distance traveled by said plates 20 and 21 both in the first distancing step C and in the second approach step D, and a final step, wherein the command and control unit 24 obliges the plates 20 and 21 to travel over a second section of distancing travel at a second relative speed of second distancing v5, lower than said first speed v4, so as to contrast the inertia relating to the weight of the container 12 and to allow the correct repositioning of the plates 20 and 21 in their initial position.

Figure 7:
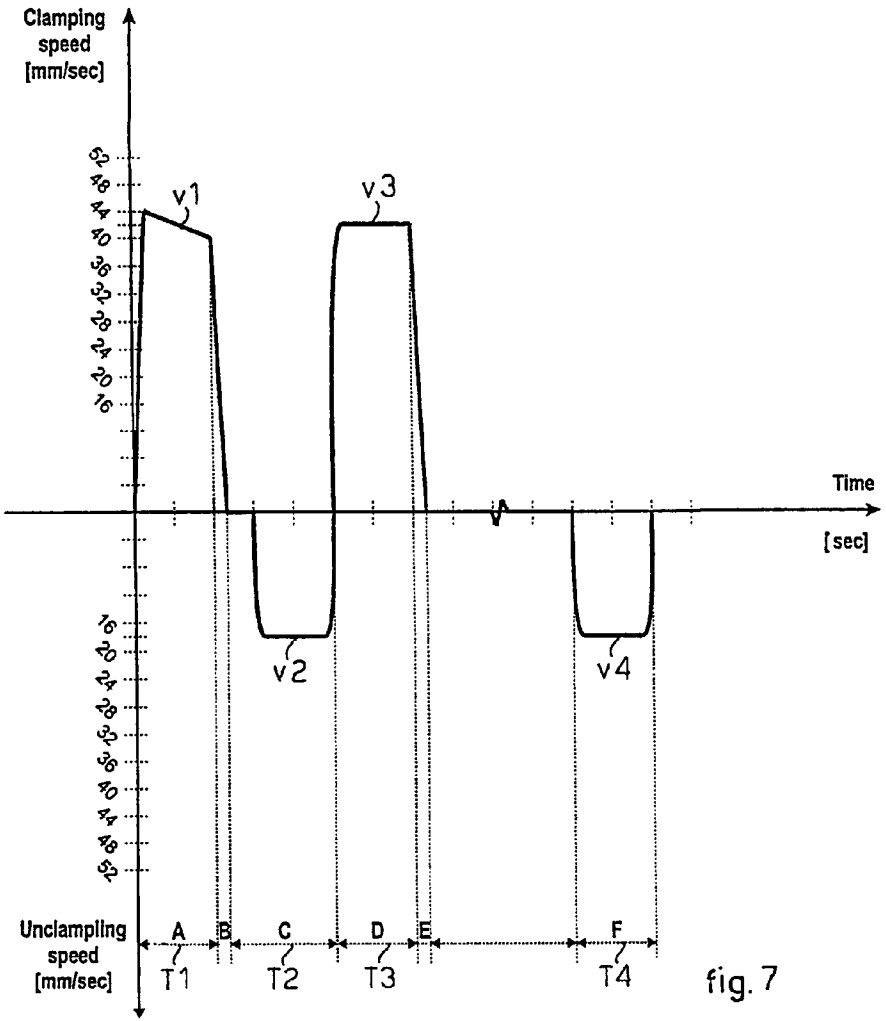
FIG. 7 is a diagram showing an example of the development of the speed of movement for a first container.

FIG. 7 shows the development of the speed profile set for a first container having a height L of about 400 mm, for which a clamping force F is determined corresponding to about 300 Kg and a consequent clamping speed v3 of about 42 mm/s.

Figure 8:
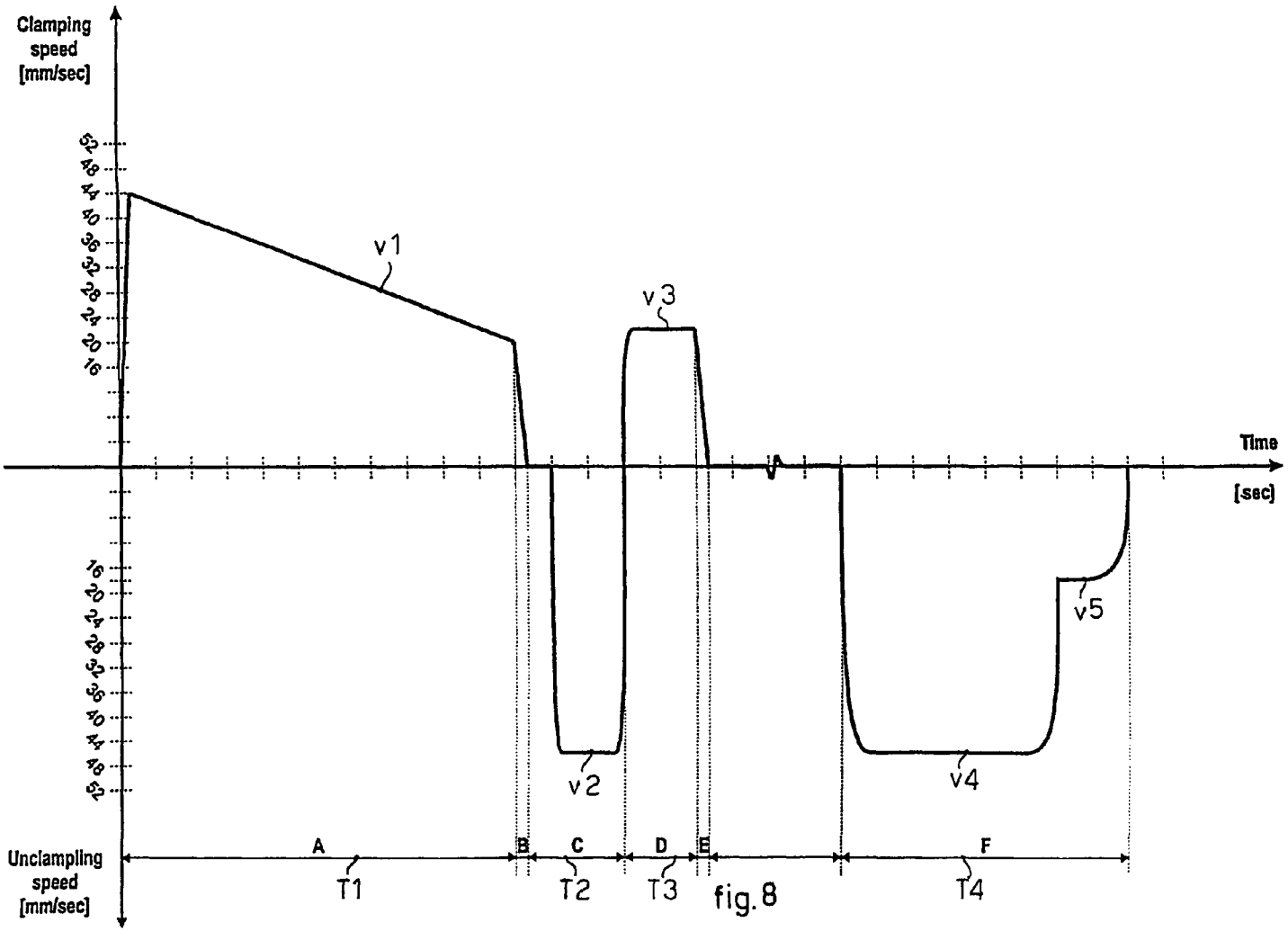
FIG. 8 is a diagram showing an example of the development of the speed of movement for a second container.

FIG. 8 shows the development of the speed profile set for a second container having a height L of about 100 mm, for which a clamping force F is determined corresponding to about 150 Kg and a consequent clamping speed v3 of about 23 mm/s.

The relative first approach speed v1 of the clamping plates 20, 21 has an initial value of about 44 mm/s and then decreases in a substantially linear manner over time.

The duration T1 of the first approach step is about 2 s and about 11 s, respectively for the first and second container, the height L of the first container being greater than that of the second container.

The first approach speed v1 therefore decreases as the distance traveled by the pressure plate 21 increases, so as to prevent damage to the little containers caused by an excessive contact speed.

To be more exact, when the first container is contacted by the pressure plate 21, the relative speed of the two plates 20, 21 is about 40 mm/s, while when the second container is contacted by the pressure plate 21, the relative speed of the two plates 20, 21 is about 20 mm/s.

Subsequently the height L of the container is determined, and then the clamping force F and consequently the clamping speed v3.

The duration T2 of the first distancing step is about 2 s, irrespective of the height L of the container; therefore, in the case of the second container 12, the two clamping plates 20, 21 are moved at a speed of first distancing v2 which is greater than that relating to the first container 12.

In the case of the first container the first distancing speed v2 is about 18=mm/s, while in the case of the second container the first distancing speed v2 is about 46 mm/s.

In the second approach step, which has a duration T3 of about 2 s, the two clamping plates 20, 21 are moved at the respective clamping speed v3, so as to obtain the corresponding clamping force F.

For the first container, the speed v3 is about 42 mm/s so as to allow a high clamping force F, while for the second container, the speed v3 is about 23 mm/s so as to allow a clamping force F sufficient to clamp the second container, but not to damage it.

After the mixing step, the two plates 20, 21 that clamp the first container are distanced from each other with a second distancing speed v4, constant and equal to about 18 mm/s. This step has a duration T4 equal to about 2 s.

The second distancing speed of the plates 20, 21 of the second container is composed of a first speed v4, constant and equal to about 46 mm/s so that the two plates 20, 21 travel the above said first section of the distancing path, and a second speed v5 of about 18 mm/s, less than the above first speed v4, so as to contrast the inertia relating to the weight of the second container and allow the correct repositioning of the plates 20 and 21 in their initial position. In this second case, the duration T4 of the second distancing step is equal to about 8 s.

It is clear that modifications and/or additions of parts may be made to the clamping device 10 and method as described heretofore, without departing from the field and scope of the present invention.

For example, it is possible to determine the distance traveled by the clamping plates 20 and 21, without using the encoder 23 but, for example, measuring the tension of the armor of the electric motor 30, or using a tachometric dynamo connected to the latter.

It is also clear that, although the present invention has been described with reference to some specific examples, a person of skill in the art shall certainly be able to achieve many other equivalent forms of clamping devices and methods to temporarily clamp, in a mixing machine, a container containing a fluid product, having the characteristics as set forth in the claims and hence all coming within the field of protection defined thereby.

The invention claimed is:

1. A clamping device for a mixing machine to temporarily clamp a container containing a fluid product, comprising:

a first clamping element on which said container is able to be disposed;

a second clamping element disposed opposite said first clamping element and able to cooperate with said first clamping element in order to clamp said container in a determinate position;

a movement mechanism able to move at least one of said clamping elements towards the other; and a command and control unit associated with said movement mechanism that causes a first reciprocal approach of said clamping elements with a first approach speed (v1) that decreases over time, so as to detect and memorize the actual height (L) of said container, the command and control unit further causing a temporary distancing of at least one of said clamping elements from said container in a determined and constant time (T2) and with a first distancing speed (v2) that is inversely proportional to said actual height (L) of said container as detected at the end of said first reciprocal approach of said clamping elements, wherein said command and control unit includes a first means able to calculate a clamping force or a clamping impulse as a function of said actual height (L) of said container, to be applied to said container, and a second means able to calculate, as a function of said clamping force, a relative clamping speed (v3) at which to move said clamping elements towards each other in order to clamp said container between said clamping elements with said clamping force, and a relative second distancing speed (v4) which is a function of said actual height (L) of said container at which to reciprocally distance said first and second clamping elements.

2. The clamping device according to claim 1, wherein said clamping force is determined as a function of said actual height (L) using an algorithm that implements an equation, a table, or a force-height interpolation curve (W), able to relate said clamping force to said actual height (L).

3. The clamping device according to claim 2, wherein said relative clamping speed (v3) is determined as a function of said clamping force using an algorithm that implements an equation, a table, or a force-speed interpolation curve (K), able to relate said relative clamping speed (v3) to said clamping force.

4. The clamping device according to claim 1, wherein said command and control unit is able to make said clamping elements maintain said relative clamping speed (v3), so as to guarantee that said clamping force is applied on said container.

5. The clamping device according to claim 1, wherein said movement mechanism comprises a screw element, connected to said clamping elements and driven by at least an electric motor, controlled by said command and control unit.

6. The clamping device according to claim 5, wherein a sensor is associated with said electric motor and with said command and control unit in order to detect said actual height (L) of said container during said first reciprocal approach of said clamping elements.

7. The clamping device according to claim 6, wherein said sensor is able to periodically detect the distance traveled by said clamping elements and to send a corresponding signal to said command and control unit.

8. The clamping device according to claim 6, wherein said command and control unit is able to memorize the signals generated by said sensor in order to determine the overall distance traveled by said clamping elements with respect to an initial position thereof.

9. The clamping device according to claim 6, wherein said command and control unit is able to intervene, in timed manner, in order to ensure a determinate value of relative speed of said clamping elements through said detections effected by said sensor unit, varying the feed tension of said electric motor.

10. The clamping device according to claim 1, wherein said clamping elements comprise surfaces facing towards said container covered with a layer of elastic material, able to allow said clamping elements to effectively clamp said container.

11. A clamping method to temporarily clamp a container, containing a fluid product, in a mixing machine, having a clamping device provided with two clamping elements between which said container is able to be clamped, a movement mechanism able to move at least one of said clamping elements towards the other, said method comprising, in sequence, the following steps:

a first approach step of bringing said clamping elements close to each other at a relative first approach speed (v1) that decreases over time;

a recognition step of recognizing that a contact has occurred between said second clamping element and said container at the end of said first approach step, and acquiring a value of an actual height (L) of said container;

a first distancing step of distancing said clamping elements from each other in a determined constant time (T2) and at a relative first distancing speed (v2) which is inversely proportional to said actual height (L) of said container as detected at the end of said first reciprocal approach of said clamping elements;

wherein said recognition step further comprises, calculating as a function of said actual height (L) of said container, a value of a clamping force, or clamping impulse, to be applied to said two clamping elements in order to clamp said container and, as a function of said clamping force, a value of a relative clamping speed (v3) at which said two clamping elements are moved towards each other, so as to clamp said container between said clamping elements with said clamping force, and a second approach step of bringing said clamping elements close to each other at said relative clamping speed (v3), until said clamping elements return to the contact position against said container;

a clamping step of clamping said container in said position of contact, with said clamping force, before starting a mixing cycle to mix said fluid product;

a second distancing step at the end of said mixing cycle, reciprocally distancing said clamping elements at a relative second distancing speed (v4) which is a function of said actual height (L) of said container so as to allow said container to be removed from said mixing machine.

12. The clamping method according to claim 11, wherein in said first approach step, a reciprocal displacement of said clamping elements occurs according to a pre-set speed profile (H), controlled and regulated by command and control unit associated with said movement mechanism.

13. The clamping method according to claim 11, wherein said actual height (L) of said container is determined in said recognition step according to an initial distance between said clamping elements and an overall distance traveled by said clamping elements during said first approach step.

14. The clamping method according to claim 11, wherein in each of said first distancing step and second approach step, moving and regulating said clamping elements with relative speeds of first and second distancing (v2, v4) which are functions of said actual height (L) of said container defined by said command and control unit.

15. The clamping method according to claim 11, wherein said second distancing step further comprises:

an initial step of moving said clamping elements move at said relative second distancing speed (v4) defined by said command and control unit according to said actual height (L) of said container, in order to travel over a precise section of distancing travel, and a final step of moving said clamping elements at a relative third distancing speed (v5), lower than said relative second distancing speed (v4), so as to travel over a second section of distancing travel until said initial position is reached.

* * * * *